United States Patent [19]

Leggett

[11] 4,273,215

[45] Jun. 16, 1981

[54] SAFETY HARNESS FOR HUNTERS

[76] Inventor: Paul Leggett, 914 Woodville Dr., Jackson, Miss. 39212

[21] Appl. No.: 964,785

[22] Filed: Nov. 29, 1978

[51] Int. Cl.[3] ..... A62B 35/00

[52] U.S. Cl. ..... 182/3; 119/96

[58] Field of Search ..... 182/3–9; 119/96, 101; 244/151 R

[56] References Cited

U.S. PATENT DOCUMENTS

| | | | |
|---|---|---|---|
| 2,996,228 | 8/1961 | Bauman | 119/96 |
| 3,301,594 | 1/1967 | Pukish | 182/3 |
| 3,321,247 | 5/1967 | Dillender | 182/3 |

*Primary Examiner*—Reinaldo P. Machado
*Attorney, Agent, or Firm*—Larry S. Nixon

[57] ABSTRACT

A safety harness particularly adapted for use by hunters who hunt from trees. The harness includes a waist web, a chest web, a shoulder web all slideably engaging a rear gang connector, a lifeline attached to the rear gang connector and adjustable quick release buckles attached to the chest and waist webs, respectively. The rear gang connector causes any tension in the lifeline to be evenly distributed between the chest web and the waist web in the event of a fall. The quick release buckles permit the hunter to release himself from the harness with one hand even when the harness is supporting his full weight.

16 Claims, 3 Drawing Figures

SAFETY HARNESS FOR HUNTERS

BACKGROUND OF THE INVENTION

The invention relates to safety harnesses, and more particularly, to a comfortable safety harness which may be removed quickly and which will not injure the user, such as a hunter, when it breaks a fall.

A hunter who hunts from a tree or a stand therein may normally situate himself 12 to 25 feet from the ground, depending on the particular tree, the terrain, the undergrowth, etc. in order to be hidden from nearby game. When a hunter is at this height, he faces great danger of sustaining serious injury in the event of a fall, a frequent occurrence among hunters. Such falls may occur from any of several causes, with or without warning, including the breaking of branches supporting the hunter, a strong wind, carelessness, or loss of consciousness.

Another problem encountered by hunters, particularly game hunters, is to drag heavy killed game, such as a deer, to an accessible road where it may be loaded onto a vehicle.

In order to protect the hunter against injury from a fall, a harness having a lifeline with a loop for gripping the tree may be worn. Such a harness could also assist in moving killed game by tieing the lifeline or a rope attached to the lifeline to the killed game so that it may be dragged along the ground with greater ease.

Safety harnesses, adapted for use by sailors, firemen, climbers, and workers utilizing scaffolds, are well known. See, e.g., U.S. Pat. Nos. 2,699,284 (Rose, 1955), 2,979,028 (Zakely, 1961), 148,744 (Parent, 1874), 1,967,767 (Diez, 1934), 3,869,021 (Sutherland et al, 1974) and 634,604 (Asche, 1899). However, these prior art harnesses are not suitable for use by hunters as described above. For example, harnesses of the prior art do not include a lifeline suitable for gripping a tree.

Furthermore, even if modified by the inclusion of a lifeline suitable for gripping a tree, these devices would suffer from several disadvantages. Such devices generally comprise a waist strap or a chest strap or both and shoulder straps holding up the chest or waist strap. In such devices, a variety of types of buckles have been utilized for securing the straps around the user's body. If both a waist strap and a chest strap are included, they are generally joined together in fixed relationship with a vertical strap, as best shown in the Rose patent identified above. Such devices have several disadvantages: In the event of a fall, most of the force restraining the user will be exerted by only one strap, causing pain and possibly loss of breath or injury. After such a fall, the user may wish to release himself from the harness, particularly if no one is nearby to render assistance. However, the user will have great difficulty doing so with prior art devices, as the buckles thereof do not have quick release features and are particularly difficult to release under the tension exerted by the lifeline. Another disadvantage of the prior art devices is that because of the generally fixed relationships of the various straps, it is not possible to adjust the locations of the buckles on the waist or chest straps for comfort and easy access, in accordance with the size and preferences of the user. Prior safety harnesses are also disadvantageous for use by hunters as a means for dragging killed game. Since the various straps of prior harnesses do not connect to a single point, their construction does not permit the pulling pressure to be evenly distributed over a wide area of the user's body. Pulling game with such a harness is therefore also painful and tiring.

BRIEF SUMMARY OF THE INVENTION

The disadvantages of the prior art devices are overcome by the present invention which provides a safety harness having a chest web, a waist web, and a shoulder web, each slideably engaging a rear gang connector; a lifeline web, having at one end an object web such as adjustable loop for attachment to a tree, and being attached at its other end to the rear gang connecter; and adjustable quick release buckles attached to the chest and waist webs, respectively. In the preferred embodiment of the invention, the shoulder web engages the rear gang connecter near the web's center and is connected at its ends to the chest web, one end being affixed thereto, the other end forming a loop and being connected by a front gang connecter which slideably engages the chest web. The webs of the preferred embodiment may suitably be composed of two inch-wide seatbelt-type material, and the quick release buckles may suitably comprise auto seatbelt-type buckles.

A safety harness of this construction increases the comfort of the user and reduces the likelihood of injury following a fall by evenly distributing the upward pressure between the chest web and the waist web. When the harness is utilized to pull heavy objects such as a killed deer along the ground by attaching the object web at the end of the lifeline web (or a rope attached to the object web) to the deer, the pulling pressure is exerted on the waist, shoulders, and chest, thereby enabling the hunter to pull the deer with greater ease than would be possible with prior safety harnesses. In the event that a hunter who has fallen from his stand desires to free himself from the harness, he need only hug the tree with his legs and one arm and release the quick release buckles, slide out of the harness, and down the tree. Another advantage of this safety harness is that the waist web, being slideably connected to the remainder of the harness, may be adjusted so that the circumferential location of the buckle thereon may be set for the comfort and convenience of the user according to his size and preference.

BRIEF DESCRIPTION OF THE DRAWINGS

These and further advantages of the invention will be apparent in considering the following detailed description of the preferred embodiment of the invention, illustrated in the accompanying drawings, wherein.

DETAILED DESCRIPTION OF THE PREFERRED EMBODIMENT

Figure 1:
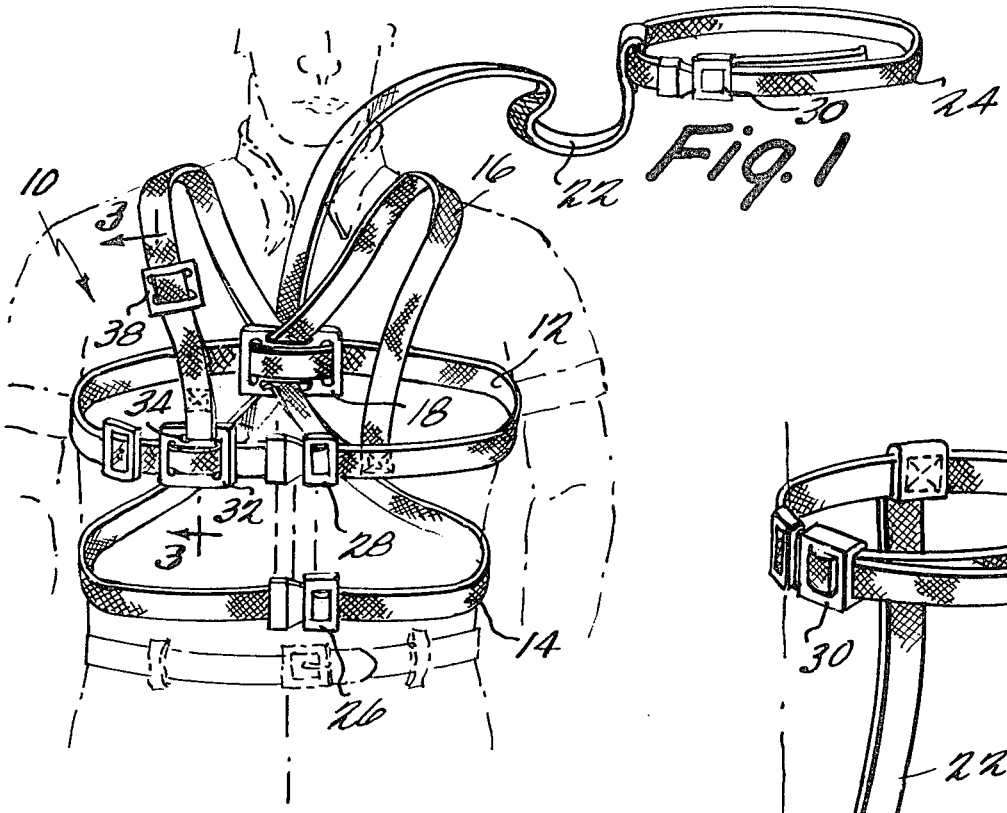
FIG. 1 is a perspective view of the preferred embodiment.

Referring to FIG. 1, safety harness 10 of the preferred embodiment includes chest web 12 which surrounds the user's chest, waist web 14 which surrounds the user's waist, and shoulder web 16 which extends over each of the user's shoulders. Each of the webs is engaged at the center of the user's back by rear gang connecter 18 as will be described. Fixedly attached to rear gang connecter 18 is loop end 20 of lifeline web 22, the other end of which is suitably fixedly attached as by sewing to a means for attaching web 22 to an object, such as an object web—suitably, adjustable loop 24. Each of webs 12, 14, 16, and 22 and loop 24 are suitably composed of two inch-wide seatbelt-type material in order to provide strength, comfort, and ease of adjustment. Other suitable materials may, of course, be utilized. A waist connecting means for detachably securing waist web 14 snugly about the waist of the subject, such as quick release buckle 26, is connected in the usual manner to waist web 14. Similarly, a chest connecting means for detachably securing chest web 12 snugly about the chest of the subject, such as quick release buckle 28, is connected in the usual manner to chest web 12.

Quick release buckles 26 and 28 must be quickly releasable with one hand even while webs 12 and 14 are applying pressure to buckles 26 and 28 such as when harness 10 is supporting the full weight of the hunter. Auto seatbelt-type buckles, particularly the kind having a pushbutton release mechanism, are utilized in the preferred embodiment, although any buckles meeting the above standards may be employed. An object connecting means, such as quick release buckle 30 for detachably securing the object web 24 snugly about the object (such as a tree trunk or killed game to be dragged) is connected in the usual manner to object web 24. Thus, the user may quickly and easily slip out of safety harness 10 or detach the lifeline 22 from the tree even when harness 10 and lifeline 22 are under great tension, by simply pushing the buttons on the quick release buckles.

Figure 3:
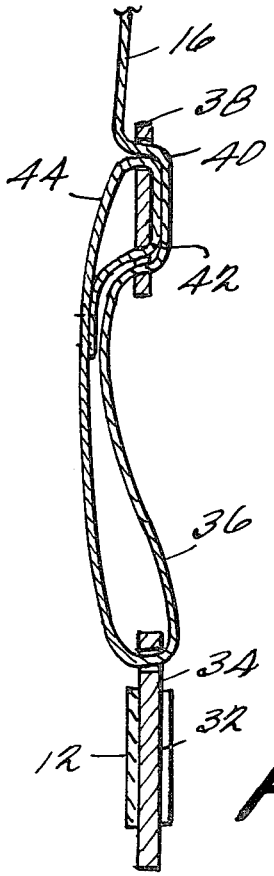
FIG. 3 is a detailed side view of the front gang connecter and the adjustable shoulder web engaged therewith.

Shoulder web 16 is attached, preferably sewn, at one end to chest web 12, engages rear gang connecter 18 near its middle and is adjustably attached to front gang connecter 32 at its other end as will be described. Referring now to FIG. 3, front gang connecter 32, suitably composed of a hard material such as plastic or metal, has an upper hole 34 through which passes end portion 36 of shoulder web 16 and two holes 38 beneath hole 34 for slideably engaging chest web 12. Slideable connecter 38 forms an adjustable loop from end 36. End 36 passes through holes 40 and 42 of slideable connecter 38, through hole 34 of front gange connecter 32 and back through holes 40 and 42 before being sewn to form fixed loop 44 through holes 40 and 42.

Figure 2:
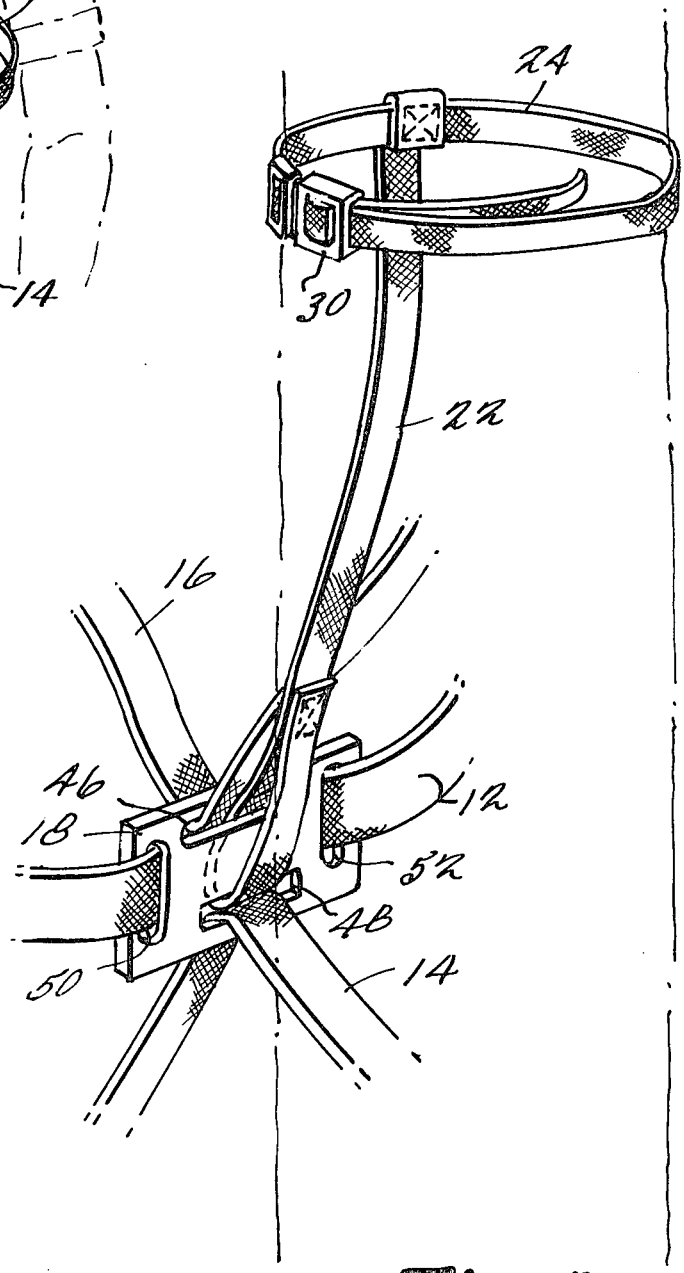
FIG. 2 is a detailed perspective of the rear gang connecter and the webs engaging therewith in accordance with the preferred embodiment.

Referring now to FIG. 2, the rear gang connecter 18 is designed so that tension on lifeline web 22 will be distributed evenly to shoulder web 16, waist web 14 and chest web 12. In order to accomplish this objective, rear gang connecter 18 has upper hole 46 for slideably engaging shoulder web 16, lower hole 48 for slideably engaging waist web 14, and side holes 50 and 52 for slideably engaging chest web 12. Fixed loop 20 of lifeline 22 connects to rear gang connecter 18 through holes 44 and 48. As is best illustrated in FIG. 1, rear gang connecter 18 will naturally adjust its position to the center of the user's back when the safety harness is worn and will cause tension if lifeline 22 to be transmitted directly from rear connecter 18 to each of the webs with which it engages.

Although only one exemplary embodiment of this invention has been described in detail above, those skilled in the art will readily appreciate that many modifications are possible in the exemplary embodiment without materially departing from the novel teachings and advantages of this invention. Accordingly all such modifications are intended to be included within the scope of this invention as defined in the following claims:

What is claimed is:

1. A safety harness for maintaining a subject proximate an object comprising:

a chest web for surrounding the subject's chest;

a waist web for surrounding the subject's waist;

rear connecting means for slidably engaging said chest web and waist web;

a shoulder web having a first end attached to said chest web and a second end, said rear connecting means slidably engaging said shoulder web;

shoulder web connecting means, engaging said chest web, for connecting said shoulder web second end to said chest web, means, engaging said shoulder web, for adjusting the length of said shoulder web;

chest connecting means, including means for adjusting the length of said chest web and a first quick release buckle, for detachably securing said chest web snugly about the chest of said subject;

waist connecting means, including means for adjusting the length of said waist web and a second quick release buckle, for detachably securing said waist web snugly about the waist of said subject;

a lifeline web having a first end and a second end, said first end having means for attachment to said rear connecting means;

said first and second buckles being of the kind which release only upon the application of a force thereto of given magnitude, said magnitude being substantially independent of the amount of tension in said waist web and said chest web, respectively.

2. Apparatus as in claim 1 wherein:

said shoulder web connecting means includes means, slidably engaging said chest web and slidable along said chest web, for slidably connecting said shoulder web second end to said chest web.

3. A safety harness for maintaining a subject proximate an object comprising:

a chest web;

a waist web;

rear connecting means for slidably engaging said chest web and waist web;

a shoulder web having a first end attached to said chest web and a second end, said rear connecting means slidably engaging said shoulder web;

shoulder web connecting means, engaging said chest web, for slidably connecting said shoulder web second end to said chest web;

means for adjusting the length of said shoulder web;

chest connecting means for detachably securing said chest web snugly about the chest of said subject;

waist connecting means for detachably securing said waist web snugly about the waist of said subject;

a lifeline web having a first end and a second end, said first end having means for attachment to said rear connecting means;

an object web, said lifeline web second end connected to said object web; and object connecting means for detachably securing said object web snugly about said object;

said shoulder web connecting means comprising a front gang connecter having an upper hole, said shoulder web second end forming a loop, said shoulder web loop being slidably attached to said front gang connector through said front gang connector upper hole.

4. Apparatus as in claim 3 wherein said waist connecting means comprises:

means for adjusting the length of said waist web; and a quick release buckle.

5. A safety harness for maintaining a subject proximate an object comprising:

a chest web;

a waist web;

rear connecting means for slidably engaging said chest web and waist web;

a shoulder web having a first end attached to said chest web and a second end, said rear connecting means slidably engaging said shoulder web;

shoulder web connecting means, engaging said chest web and slidable along said chest web, for slidably connecting said shoulder web second end to said chest web;

chest connecting means, including means for adjusting the length of said chest web and a first quick release buckle, for detachably securing said chest web snugly about the chest of said subject;

waist connecting means, including means for adjusting the length of said waist web and a second quick release buckle, for detachably securing said waist web snugly about the waist of said subject;

a lifeline web having a first end and a second end, said first end having means for attachment to said rear connecting means;

an object web, said lifeline web second end connected to said object web; and object connecting means for detachably securing said object web snugly about said object;

said first and second buckles being of the kind which release only upon the application of a force thereto of given magnitude, said magnitude being substantially independent of the amount of tension in said waist web and said chest web, respectively.

6. Apparatus as in any of the claims 1, 3 or 5 wherein said means for attaching said lifeline web first end to said rear connecting means includes a loop formed from said first end, said loop being slidably attached to said rear connecting means.

7. Apparatus as in claim 6 wherein said rear connecting means for slideably engaging comprises a gang connecter having a first upper hole for slideably receiving therethrough said shoulder web and said lifeline web loop, a second lower hole for slideably receiving therethrough said waist web and said life-line web loop, and third and fourth holes for slideably receiving therethrough said chest web.

8. Apparatus as in claim 1 or claim 5 wherein said engaging and slidably connecting shoulder web connecting means comprises a front gang connecter having an upper hole, said shoulder web second end forming a loop, said shoulder web loop being slidably attached to said shoulder web gang connecter through said front gang connecter upper hole.

9. Apparatus as in claim 8 wherein said shoulder web length adjusting means comprises means attached to and engaging said shoulder web for slideably adjusting the size of said shoulder web loop.

10. A safety harness for maintaining a subject proximate an object comprising:

a chest web;

a waist web;

rear connecting means for slidably engaging said chest web and said waist web;

a shoulder web having a first end attached to said chest web and a second end, said rear connecting means slidably engaging said shoulder web;

shoulder web connecting means, slidably engaging said chest web, for slidably connecting said shoulder web second end to said chest web;

means, engaging said shoulder web, for adjusting the length of said shoulder web;

chest connecting means, including means for adjusting the length of said chest web and a first quick release buckle, for detachably securing said chest web snugly about the chest of said subject;

waist connecting means, including means for adjusting the length of said waist web and a second quick release buckle, for detachably securing said waist web snugly about the waist of said subject;

a lifeline web having a first end in the form of a loop for slidable attachment to said rear connecting means, and a second end;

an object web, said lifeline web second end being connected to said object web; and object connecting means for detachably securing said object web snugly about said object;

said rear connecting means comprising a gang connecter having a first upper hole for slidably receiving therethrough said shoulder web and said lifeline web loop, a second lower hole for slidably receiving therethrough said waist web and said lifeline web loop, and third and fourth holes for slidably receiving therethrough said chest web.

11. A safety harness for maintaining a subject proximate an object comprising:

a chest web;

a waist web;

rear connecting means for slidably engaging said chest web and said waist web;

a shoulder web having a first end attached to said chest web and a second end, said rear connecting means slidably engaging said shoulder web;

shoulder web connecting means, engaging said chest web, for slidably connecting said shoulder web second end to said chest web;

means for adjusting the length of said shoulder web;

chest connecting means for detachably securing said chest web snugly about the chest of said subject;

waist connecting means for detachably securing said waist web snugly about the waist of said subject;

a lifeline web having a first end in the form of a loop for slidable attachment to said rear connecting means, and a second end;

an object web, said lifeline web second end being connected to said object web;

object connecting means for detachably securing said object web snugly about said object;

said rear connecting means for slidably engaging comprising a gang connecter having a first upper hole for slidably receiving therethrough said shoulder web and said lifeline web loop, a second lower hole for slidably receiving therethrough said waist web and said lifetime web loop, and third and fourth holes for slidably receiving therethrough said chest web.

12. A safety harness for maintaining a subject proximate an object comprising:

a chest web;

a waist web;

rear connecting means for slidably engaging said chest web and waist web;

a shoulder web having a first end attached to said chest web and a second end, said rear connecting means slidably engaging said shoulder web;

shoulder web connecting means engaging said chest web for slidably connecting said shoulder web second end to said chest web;

chest connecting means, including means for adjusting the length of said chest web and a quick release buckle, for detachably securing said chest web snugly about the chest of said subject;

waist connecting means, including means for adjusting the length of said waist web and a quick release buckle, for detachably securing said waist web snugly about the waist of said subject;

a lifeline web having a first end in the form of a loop for slidable attachment to said rear connecting means, and a second end;

an object web, said lifeline web second end connected to said object web; and object connecting means for detachably securing said object web snugly about said object;

said rear connecting means comprising gang connecter having a first upper hole for slidably receiving therethrough said shoulder web and said lifeline web loop, a second lower hole for slidably receiving therethrough said waist web and said lifeline web loop, and third and fourth holes for slidably receiving therethrough said chest web.

13. A safety harness for maintaining a subject proximate an object comprising:

a chest web;

a waist web;

rear connecting means for slidably engaging said chest web and said waist web;

a shoulder web having a first end attached to said chest web and a second end, said rear connecting means engaging said shoulder web;

shoulder web connecting means, engaging said chest web, for connecting said shoulder web second end to said chest web;

means, engaging said shoulder web, for adjusting the length of said shoulder web;

chest connecting means, including means for adjusting the length of said chest web and a first quick release buckle, for detachably securing said chest web snugly about the chest of said subject;

waist connecting means, including means for adjusting the length of said waist web and a second quick release buckle, for detachably securing said waist web snugly about the waist of said subject;

a lifeline web having a first end in the form of a loop for slidable attachment to said rear connecting means and a second end;

an object web, said lifeline web second end being connected to said object web; and object connecting means for detachably securing said object web snugly about said object;

said shoulder web connecting means comprising a front gang connecter having an upper hole, said shoulder web second end forming a loop, said shoulder web loop being slidably attached to said front gang connecter through said front gang connecter upper hole.

14. A safety harness for maintaining a subject proximate an object comprising:

a chest web;

a waist web;

rear connecting means for slidably engaging said chest web and waist web;

a shoulder web having a first end attached to said chest web and a second end, said rear connecting means slidably engaging said shoulder web;

shoulder web connecting means engaging said chest web to slidably connecting said shoulder web second end to said chest web;

chest connecting means, including means for adjusting the length of said chest web and a quick release buckle, for detachably securing said chest web snugly about the chest of said subject;

waist connecting means, including means for adjusting the length of said waist web and a quick release buckle, for detachably securing waist web snugly about the waist of said subject;

a lifeline web having a first end and a second end, said first end having means for attachment to said rear connecting means;

an object web, said lifeline web second end connected to said object web; and object connecting means for detachably securing said object web snugly about said object;

said shoulder web connecting means comprising a front gang connecter having an upper hole, said shoulder web second end forming a loop, said shoulder web loop being slidably attached to said shoulder web gang connecter through said front gang connecter upper hole.

15. Apparatus as in claim 1 wherein said object connecting means comprises a third quick release buckle of the kind which releases upon the application thereto of a force of given magnitude, said magnitude being substantially independent of the amount of tension in said object web.

16. Apparatus as in claim 1 or claim 5 or claim 15 wherein said rear connecting means comprises a rear gang connecter having a first hole for slidably receiving therethrough said shoulder web, a second hole disposed below said first hole for slidably receiving therethrough said waist web and third and fourth holes for slidably receiving therethrough said chest web said rear gang connecter being attached to said lifeline first end.

* * * * *